US009671150B2

(12) United States Patent
Kim

(10) Patent No.: US 9,671,150 B2
(45) Date of Patent: Jun. 6, 2017

(54) COOLING APPARATUS AND CONTROL METHOD THEREOF

(71) Applicant: SAMSUNG ELECTRONICS CO., LTD., Suwon-si (KR)

(72) Inventor: Sun Jin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 796 days.

(21) Appl. No.: 13/955,620

(22) Filed: Jul. 31, 2013

(65) Prior Publication Data

US 2014/0033744 A1 Feb. 6, 2014

(30) Foreign Application Priority Data

Aug. 1, 2012 (KR) ..... 10-2012-0084596

(51) Int. Cl.

| | |
|---|---|
| ***F25D 21/06*** | (2006.01) |
| ***F25D 21/00*** | (2006.01) |
| ***F25B 49/02*** | (2006.01) |
| ***F25D 21/08*** | (2006.01) |

(52) U.S. Cl.

CPC ..... *F25D 21/002* (2013.01); *F25B 49/025* (2013.01); *F25D 21/006* (2013.01); *F25D 21/08* (2013.01); *F25B 2600/024* (2013.01)

(58) Field of Classification Search

CPC ..... F25D 21/002; F25D 21/006; F25D 21/08; F25B 49/025; F25B 2600/024

See application file for complete search history.

(56) References Cited

U.S. PATENT DOCUMENTS 4,327,556 A 5/1982 Zampini et al.
5,479,785 A * 1/1996 Novak ..... F25D 21/002 62/155
5,799,498 A * 9/1998 Park ..... F25D 21/02 62/140

(Continued)

FOREIGN PATENT DOCUMENTS

CN 101392977 A 3/2009
CN 101545707 A 9/2009

(Continued)

OTHER PUBLICATIONS

Chinese Office Action dated Sep. 8, 2016 in corresponding Chinese Patent Application No. 201310331546.0.

*Primary Examiner* — Larry Furdge
(74) *Attorney, Agent, or Firm* — Staas & Halsey LLP

(57) ABSTRACT

Disclosed herein are a cooling apparatus and a control method thereof. The cooling apparatus using latent heat of a refrigerant includes evaporators evaporating the refrigerant, a compressor compressing the evaporated refrigerant to a high pressure, defrosting heaters removing frost accumulated on the evaporators, a driving unit providing driving current selectively to the compressor or the defrosting heaters, and a control unit controlling the driving unit to provide driving current to the compressor in a cooling operation mode and controlling the driving unit to provide driving current to the defrosting heaters in a defrosting operation mode. The cooling apparatus controls the defrosting heaters using a driving circuit controlling the compressor, and thus lowers the manufacturing costs of a refrigerator operated at DC power.

16 Claims, 10 Drawing Sheets

(56) References Cited

U.S. PATENT DOCUMENTS

| | | | | |
|---|---|---|---|---|
| 2003/0033822 | A1* | 2/2003 | Zangari | F25D 17/042 62/156 |
| 2004/0178759 | A1* | 9/2004 | Nakamura | B60H 1/00828 318/471 |
| 2009/0241561 | A1* | 10/2009 | Han | F25D 21/02 62/80 |

FOREIGN PATENT DOCUMENTS

| | | | |
|---|---|---|---|
| JP | 2004-76995 | | 3/2004 |
| WO | 03/004950 | A1 | 1/2003 |

* cited by examiner

COOLING APPARATUS AND CONTROL METHOD THEREOF

CROSS-REFERENCE TO RELATED APPLICATIONS

This application claims the benefit of Korean Patent Application No. 10-2012-0084596, filed on Aug. 1, 2012 in the Korean Intellectual Property Office, the disclosure of which is incorporated herein by reference.

BACKGROUND

1. Field

Embodiments of the present disclosure relate to a refrigerator which drives defrosting heaters using a driving unit driving a compressor, and a control method thereof.

2. Description of the Related Art

A refrigerator receives AC power from an external power source, switches the AC power to DC power, and then uses the DC power. Therefore, AC power is supplied to a defrosting heater removing frost accumulated on an evaporator cooling a storage chamber of the refrigerator, and a component for AC power, such as a relay or a triac, is used to control operation of the defrosting heater.

Recently, in order to reduce energy loss consumed to execute switch from AC power to DC power, researchers have been investigating a hybrid system which supplies DC power directly to respective homes or supplies DC power generated by solar photovoltaic generation or fuel cell generation to respective homes are underway.

As described above, the most used component as a unit to turn the defrosting heater of the refrigerator on/off at AC power is a relay or a triac.

The triac is a component for exclusive use of AC power, and is thus not used to control the on/off of the defrosting heater at DC power.

The relay is variously commercialized to a rated voltage of AC220V and current capacity of several tens of Amperes in case of AC power, but generally has a rated voltage of DC30V and current capacity of several Amperes in case of DC power. Therefore, it may be difficult for the conventional relay to turn the defrosting heater on/off by supplying DC voltage of about 300V or more.

Therefore, in order to control a defrosting heater operated at a voltage of DC300V or more in a system using DC power, a control circuit is formed using an expensive power semiconductor, such as an insulated gate bipolar mode transistor (IGBT) or a high voltage field effect transistor (FET), and thereby, the manufacturing costs of the refrigerator are raised.

SUMMARY

Therefore, it is an aspect of the present disclosure to provide a refrigerator which controls defrosting heaters operated at high voltage DC power using a driving circuit controlling a compressor, and a control method thereof.

Additional aspects will be set forth in part in the description which follows and, in part, will be obvious from the description, or may be learned by practice of the invention.

In accordance with one aspect, a cooling apparatus using latent heat of a refrigerant includes evaporators evaporating the refrigerant, a compressor compressing the evaporated refrigerant to a high pressure, defrosting heaters removing frost accumulated on the evaporators, a driving unit providing driving current selectively to the compressor or the defrosting heaters, and a control unit controlling the driving unit to provide driving current to the compressor in a cooling operation mode and controlling the driving unit to provide driving current to the defrosting heaters in a defrosting operation mode.

The driving unit may include a driving circuit providing driving current to the compressor or the defrosting heaters, a terminal switching circuit provided between the compressor and the driving circuit and switching driving current provided to the compressor, and a defrosting switching circuit provided between the defrosting heaters and the driving circuit and switching driving current provided to the defrosting heaters.

Specifically, the driving circuit may include at least two output terminals, the terminal switching circuit may include at least two terminal switches, designated sides of the at least two terminal switches may be respectively connected to the at least two output terminals of the driving circuit, the other sides of the at least two terminal switches may be respectively connected to power terminals of the compressor, the defrosting switching circuit may include at least one defrosting switch connected to the defrosting heaters, the at least one defrosting switch may be connected to one of the at least two output terminals of the driving circuit, and the defrosting heaters may be connected to the other of the at least two output terminals of the driving circuit.

The driving circuit may include at least two transistors connected to power and at least two transistors connected to ground. The driving circuit may provide driving current to the compressor or the defrosting heaters by turning one of the at least two transistors connected to power on and turning one of the at least two transistors connected to ground on.

When driving current is provided to the compressor, the control unit may turn the terminal switching circuit on and controls the driving circuit so as to provide driving current to the compressor. When driving current is provided to the defrosting heaters, the control unit may turn the defrosting switching circuit on and controls the driving circuit so as to provide driving current to the defrosting heaters.

The cooling apparatus may further include defrosting temperature sensing units sensing the temperatures of the evaporators, and the control unit may control the driving circuit so as to provide driving current to the defrosting heaters according to a sensing result of the defrosting temperature sensing units.

Specifically, the control unit may control the driving circuit so as to provide driving current from the driving circuit to the defrosting heaters when the temperatures of the evaporators are lower than defrosting termination temperatures, and control the driving circuit so as to cut off driving current provided from the driving circuit to the defrosting heaters when the temperatures of the evaporators are not lower than the defrosting termination temperatures.

The cooling apparatus may further include defrosting heater overheating prevention units cutting driving current provided to the defrosting heaters off by turning the defrosting switching circuit off when the temperatures of the evaporators are not lower than defrosting cutoff temperatures.

In accordance with one aspect, a driving apparatus driving a cooling apparatus which has evaporators evaporating a refrigerant, a compressor compressing the evaporated refrigerant to a high pressure, and defrosting heaters removing frost accumulated on the evaporators, includes a driving circuit providing driving current to the compressor or the defrosting heaters, a terminal switching circuit switching driving current provided from the driving circuit to the compressor, and a defrosting switching circuit provided switching driving current provided from the driving circuit to the defrosting heaters, wherein the terminal switching circuit and the defrosting switching circuit are connected in parallel with respect to the driving circuit.

The driving apparatus may further include a control unit controlling the driving circuit, the terminal switching circuit and the defrosting switching circuit to provide driving current to the compressor in a cooling operation mode, and controlling the driving circuit, the terminal switching circuit and the defrosting switching circuit to provide driving current to the defrosting heaters in a defrosting operation mode.

The driving circuit may include at least two output terminals, the terminal switching circuit may include at least two terminal switches provided between the driving circuit and the compressor, designated sides of the at least two terminal switches may be respectively connected to the at least two output terminals of the driving circuit, the other sides of the at least two terminal switches may be respectively connected to power terminals of the compressor, the defrosting switching circuit may include at least one defrosting switch connected to the defrosting heaters, the at least one defrosting switch may be connected to one of the at least two output terminals of the driving circuit, and the defrosting heaters may be connected to the other of the at least two output terminals of the driving circuit.

The driving circuit may include at least two transistors connected to power and at least two transistors connected to ground. The driving circuit may provide driving current to the compressor or the defrosting heaters by turning one of the at least two transistors connected to power and one of the at least two transistors connected to ground on.

In accordance with one aspect, a control method of a cooling apparatus which has evaporators evaporating a refrigerant, a compressor compressing the evaporated refrigerant and defrosting heaters removing frost accumulated on the evaporators, and is operated in a cooling operation mode to operate the compressor and in a defrosting operation mode to operate the defrosting heaters, includes judging whether or not the current operation mode of the cooling apparatus is switched to the other operation mode, cutting driving current provided to one of the compressor and the defrosting heaters off from a driving circuit of the cooling apparatus, upon judging that the current operation mode of the cooling apparatus is switched to the other operation mode, switching a terminal switching circuit provided between the compressor and the driving circuit and a defrosting switching circuit provided between the defrosting heaters and the driving circuit, and executing the switched operation mode by providing driving current to the other of the compressor and the defrosting heaters from the driving circuit.

Specifically, if the cooling operation mode is switched to the defrosting operation mode, the defrosting operation mode may be executed by cutting driving current provided to the compressor from the driving circuit off, turning the terminal switching circuit off, turning the defrosting switching circuit on, and providing driving current to the defrosting heaters from the driving circuit.

Further, driving current may be provided to the defrosting heaters according to temperatures of the evaporators in the defrosting operation mode. Specifically, driving current may be provided to the defrosting heaters when the temperatures of the evaporators are lower than defrosting termination temperatures, and driving current provided to the defrosting heaters may be cut off when the temperatures of the evaporators are not lower than the defrosting termination temperatures.

Further, the defrosting switching circuit may be turned off in the defrosting operation mode when the temperatures of the evaporators are not lower than defrosting cutoff temperatures.

If the defrosting operation mode is switched to the cooling operation mode, the cooling operation mode may be executed by cutting driving current provided to the defrosting heaters from the driving circuit off, turning the defrosting switching circuit off, turning the terminal switching circuit on, and providing driving current to the compressor from the driving circuit.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
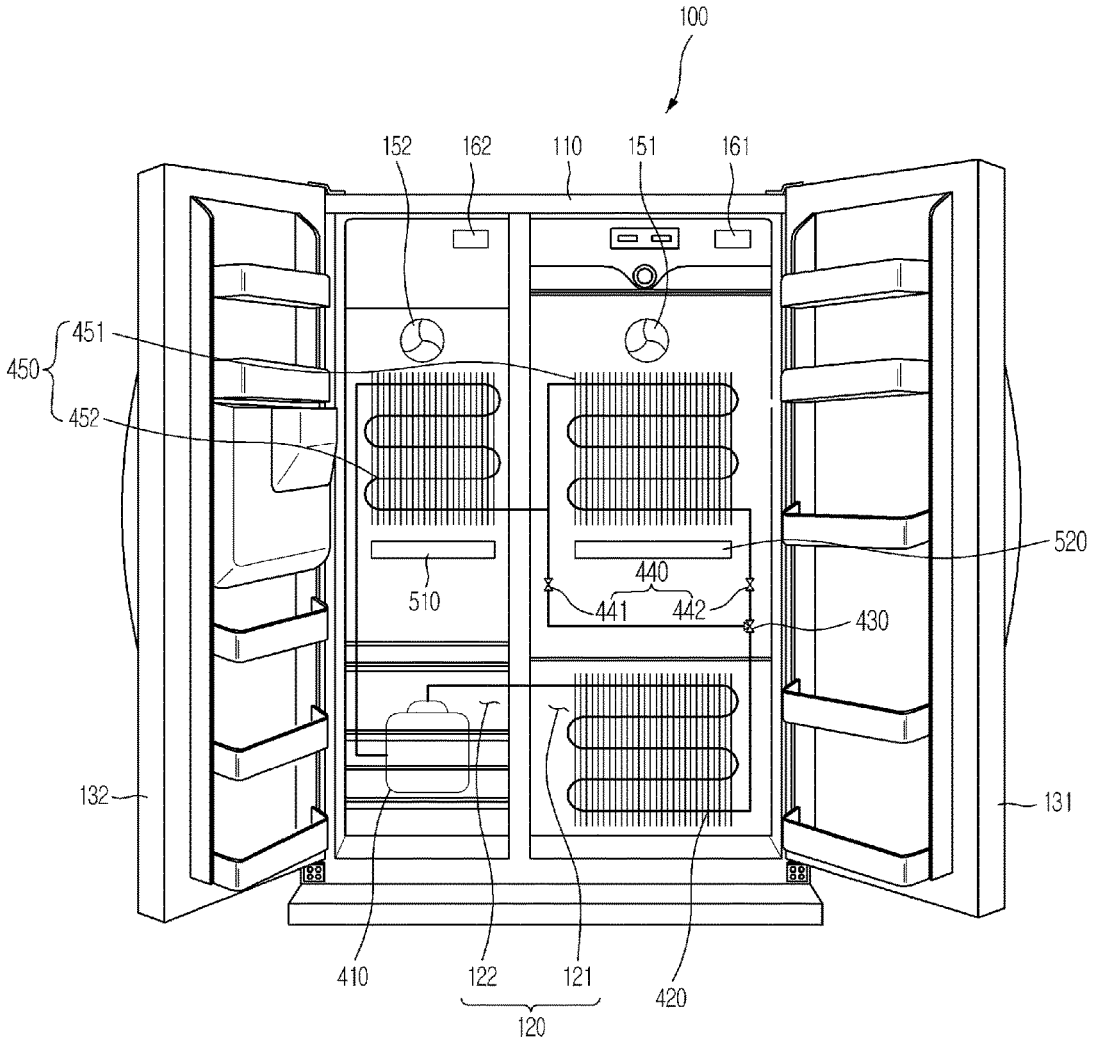
FIG. 1 is a view briefly illustrating a refrigerator in accordance with one embodiment.

Reference will now be made in detail to the embodiments, examples of which are illustrated in the accompanying drawings, wherein like reference numerals refer to like elements throughout.

Although one embodiment exemplarily describes a refrigerator, embodiments of the present invention are not limited thereto and may be applied to any cooling apparatus including an evaporator, a compressor and a defrosting heater, such as a refrigerator, an air conditioner, etc.

Figure 2:
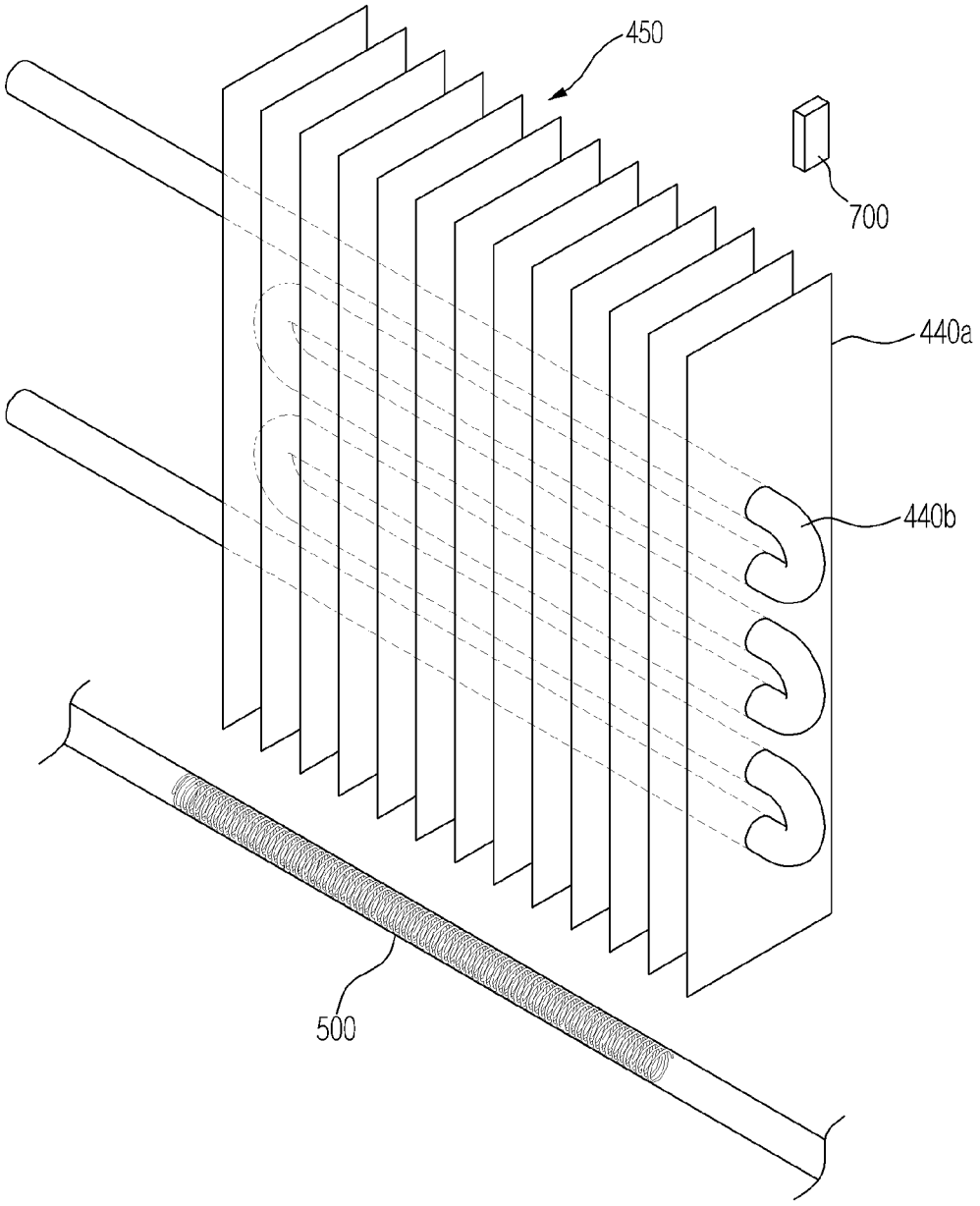
FIG. 2 is a perspective view illustrating an evaporator, a defrosting heater and a defrosting temperature sensing unit in accordance with the embodiment.

FIG. 1 is a view briefly illustrating a refrigerator 100 in accordance with one embodiment, and FIG. 2 is a perspective view illustrating an evaporator 450, a defrosting heater 500 and a defrosting temperature sensing unit 700 in accordance with the embodiment.

With reference to FIGS. 1 and 2, the refrigerator 100 in accordance with the embodiment includes a main body 110 forming the external appearance of the refrigerator 100, storage chambers 120 storing articles, and a cooling apparatus cooling the storage chambers 120.

Ducts (not shown) in which evaporators 450 of the cooling apparatus are installed are provided in the inner space of the main body 110, and a machine chamber (not shown), in which a compressor 410 and a condenser 420 of the cooling apparatus are installed, is provided in the lower portion of the main body.

The storage chambers 120 storing articles are provided in the main body 110.

The storage chambers 120 includes a first storage chamber 121 storing articles in a refrigerated state and a second storage chamber 122 storing articles in a frozen state which are divided side by side by a diaphragm, and the front surfaces of the first storage chamber 121 and the second storage chamber 122 are opened.

Storage temperature sensing units 161 and 162 sensing temperatures of the storage chambers 121 and 122 are provided in the respective storage chambers 121 and 122. Specifically, a first storage temperature sensing unit 161 sensing the temperature of the first storage chamber 121 and providing the sensed temperature to a control unit which will be described later is provided in the first storage chamber 121, and a second storage temperature sensing unit 162 sensing the temperature of the second storage chamber 122 and providing the sensed temperature to the control unit is provided in the second storage chamber 122.

These storage temperature sensing units 161 and 162 may employ, for example, thermistors, electric resistances of which are varied according to temperature.

Doors 131 and 132 shielding the first storage chamber 121 and the second storage chamber 122, the front surfaces of which are opened, from the outside are provided. A display unit (not shown) displaying operation information of the refrigerator 100 and an input unit (not shown) receiving operation instructions from a user may be provided on the doors 131 and 132. Further, a door dehumidifying heater to dehumidify the doors 131 and 132 may be provided.

The cooling apparatus includes the compressor 410, the condenser 420, a switching valve 430, expansion valves 440 and evaporators 450.

The compressor 410 is installed in the machine chamber (not shown) provided in the lower portion of the main body 110, compresses a refrigerant in a low-pressure vapor phase evaporated by the evaporators 450 to a high pressure using rotating force of a motor rotated by electric energy supplied from an external power source, and transfers the refrigerant in the high-pressure vapor phase to the condenser 420 under high pressure.

The electric motor provided in the compressor 410 receives driving current supplied from a driving unit which will be described later, and rotates a rotary shaft through magnetic interaction between a rotor and a stator. Such rotating force generated by the motor is converted into a rectilinearly moving force by a piston (not shown) of the compressor 410, and the compressor 410 compresses the refrigerant in the low-pressure vapor phase to a high pressure through the rectilinearly moving force of the piston. Otherwise, rotating force generated by the motor of the compressor 410 may be transmitted to rotary blades (not shown) connected to the rotary shaft of the motor, and the refrigerant in the low-pressure vapor phase may be compressed to the high-pressure vapor phase using stick-slip between the rotary blades (not shown) and a container (not shown) of the compressor 410.

As the electric motor of the compressor 410 of the refrigerator 100 in accordance with the embodiment, for example, a brushless direct current (BLDC) motor is employed. However, embodiments are not limited thereto, and the compressor 410 may employ an inductive AC servomotor or a synchronous AC servomotor.

The refrigerant may circulate along the condenser 420, the expansion valves 440 and the evaporators 450 through pressure generated by the compressor 410. That is, the compressor 410 plays the most important part in the cooling apparatus cooling the storage chambers 120, and driving of the cooling apparatus may denote driving of the compressor 410.

The condenser 420 may be installed in the machine chamber (not shown) provided in the lower portion of the main body 110, or be installed at the outside of the main body 110, particularly, on the rear surface of the refrigerator 100.

The refrigerant in the vapor phase compressed by the compressor 410 is condensed into a liquid phase through the condenser 420. During such a condensing process, the refrigerant discharges latent heat to the condenser 420. Latent heat of the refrigerant means thermal energy discharged from the refrigerant to the outside while the refrigerant in the vapor phase cooled to the boiling point is converted into the liquid phase of the same temperature. Further, thermal energy absorbed by the refrigerant from the outside while the refrigerant in the liquid phase heated to the boiling point is converted into the vapor phase of the same temperature may be also referred to as latent heat.

Since the temperature of the condenser 420 is increased by latent heat discharged from the refrigerant, if the condenser 420 is installed in the machine chamber, a separate radiation fan (not shown) to cool the condenser 420 may be provided.

The path of the refrigerant in the liquid phase condensed by the condenser 420 is determined by the switching valve 430. The switching valve 430 selects the path of the refrigerant under the control of the control unit which will be described later. The refrigerant may pass through both a first evaporator 451 cooling the first storage chamber 121 and a second evaporator 452 cooling the second storage chamber 122 or pass through only the second evaporator 452 by the switching valve 430. That is, if the first storage chamber 121 needs to be cooled, the control unit controls the switching valve 430 so that the refrigerant may pass through both the first evaporator 451 and the second evaporator 452, and if the second storage chamber 122 needs to be cooled, the control unit controls the switching valve 430 so that the refrigerant may pass through only the second evaporator 452.

The switching valve 430 may employ a T-shaped 3-way valve having fluid entrances provided in three directions.

The refrigerant in the liquid phase condensed by the condenser 420 is decompressed by the expansion valves 440. Specifically, the expansion valves 440 decompress the refrigerant in the liquid phase to a pressure at which the refrigerant may be evaporated by throttling. Throttling means a phenomenon that when a fluid passes through a narrow path, such as a nozzle or an orifice, the pressure of the fluid is lowered even without heat exchange with the outside.

Further, the expansion valves 440 may adjust the amounts of the refrigerant provided to the evaporators 450 so that the refrigerant may absorb sufficient thermal energy from the evaporators 450, and opening/closing and opening degrees of the expansion valves 440 may be adjusted by the control unit which will be described later.

The evaporators 450 are provided in the ducts (not shown) provided in the inner space of the main body 110, as described above, and each of the evaporators 450 includes a refrigerant pipe 450*b* in which the refrigerant moves and plural cooling fins 450*a* installed on the refrigerant pipe 450*b* and increasing heat exchange efficiency (with reference to FIG. 2).

The evaporators 450 evaporate the refrigerant in the low-pressure liquid phase decompressed by the expansion valves 440. During such an evaporating process, the refrigerant in the liquid phase absorbs latent heat from the evaporators 450. The evaporators 450 discharge thermal energy to the refrigerant and are thus cooled, and air around the evaporators 450 is cooled by the cooled evaporators 450. That is, air in the ducts (not shown) is cooled due to evaporation of the refrigerant in the liquid phase.

The refrigerant in the low-pressure vapor phase evaporated by the evaporators 450 is provided to the compressor 410, thereby repeating the refrigerating cycle.

During the cooling process of the evaporators 450 by evaporation of the refrigerant, frost may be accumulated on the evaporators 450 by sublimation of water vapor around the evaporators 450 or by freezing of water acquired through condensation of water vapor around the evaporators 450 on the surface of the evaporators 450. Frost accumulated on the evaporators 450 lowers heat exchange efficiency of the evaporators 450, and consequently lowers cooling efficiency of the refrigerator 100.

In order to remove frost accumulated on the evaporators 450, defrosting heaters 500 are provided below the evaporators 450. The defrosting heaters 450 include electric heaters generating Joule's heat through electric resistances.

The defrosting heaters 500 include a first defrosting heater 510 removing frost accumulated on the first evaporator 451 provided in the first storage chamber 121, and a second defrosting heater 520 removing frost accumulated on the second evaporator 452 provided in the second storage chamber 122.

Defrosting temperature sensing units 700 sensing the temperatures of the evaporators 450 are provided above the evaporators 450. The defrosting temperature sensing units 700 include a first defrosting temperature sensing unit 710 sensing the temperature of the first evaporator 451 and a second defrosting temperature sensing unit 720 sensing the temperature of the second evaporator 452, and provide the temperatures of the evaporators 450 to the control unit and defrosting heater overheating prevention units which will be described later.

Cooling fans 151 and 152 circulate air between the ducts (not shown) in the main body 110 and the storage chambers 121 and 122. That is, the cooling fans 151 and 152 supply air cooled by the evaporators 450 provided in the ducts (not shown) to the storage chambers 120, and intake air in the storage chambers 120 into the ducts (not shown) in which the evaporators 450 are provided so as to cool the air in the storage chambers 120.

The cooling fans 151 and 152 are provided so as to correspond to the first storage chamber 121 and the second storage chamber 122, and include a first cooling fan 151 circulating air between the duct (not shown) provided in the first storage chamber 121 and the first storage chamber 121 and a second cooling fan 152 circulating air between the duct (not shown) provided in the second storage chamber 122 and the second storage chamber 122.

Figure 3:
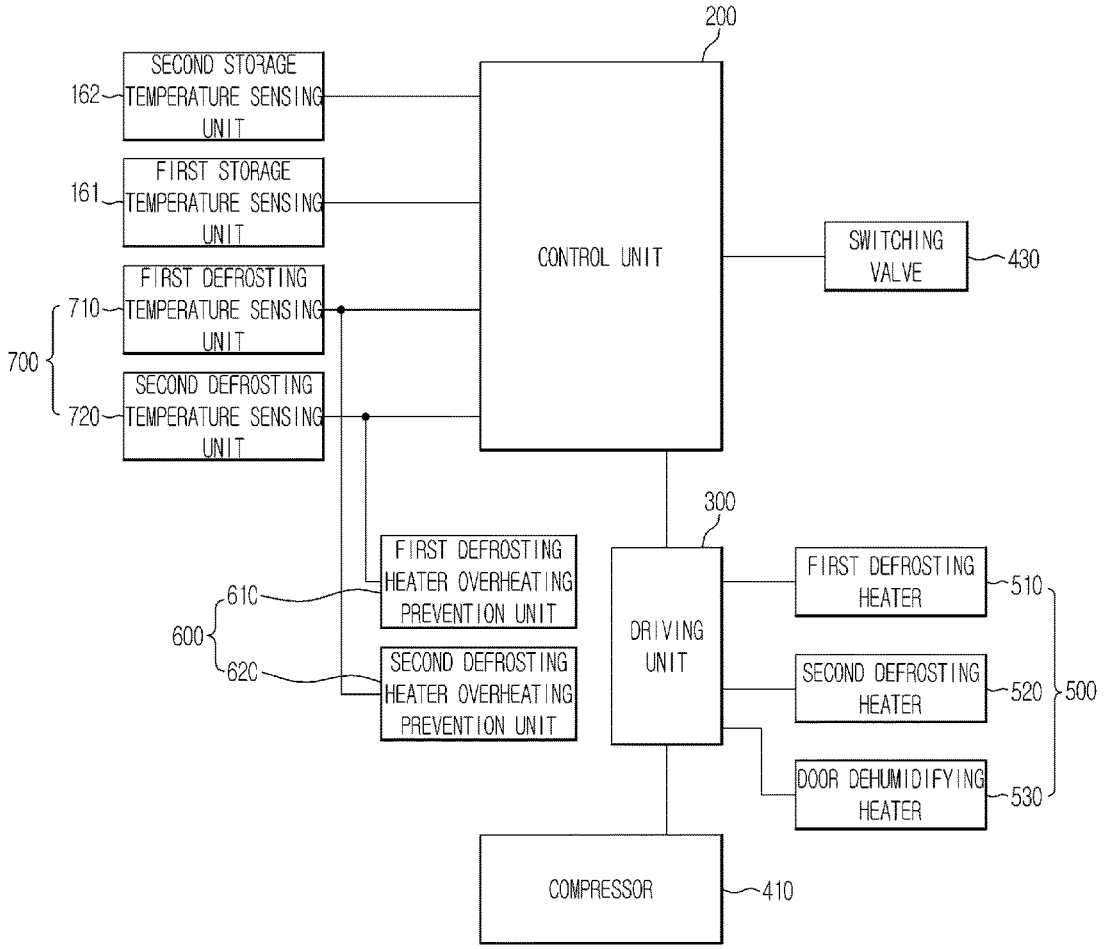
FIG. 3 is a block diagram briefly illustrating control flow of the refrigerator in accordance with the embodiment.
Figure 4:
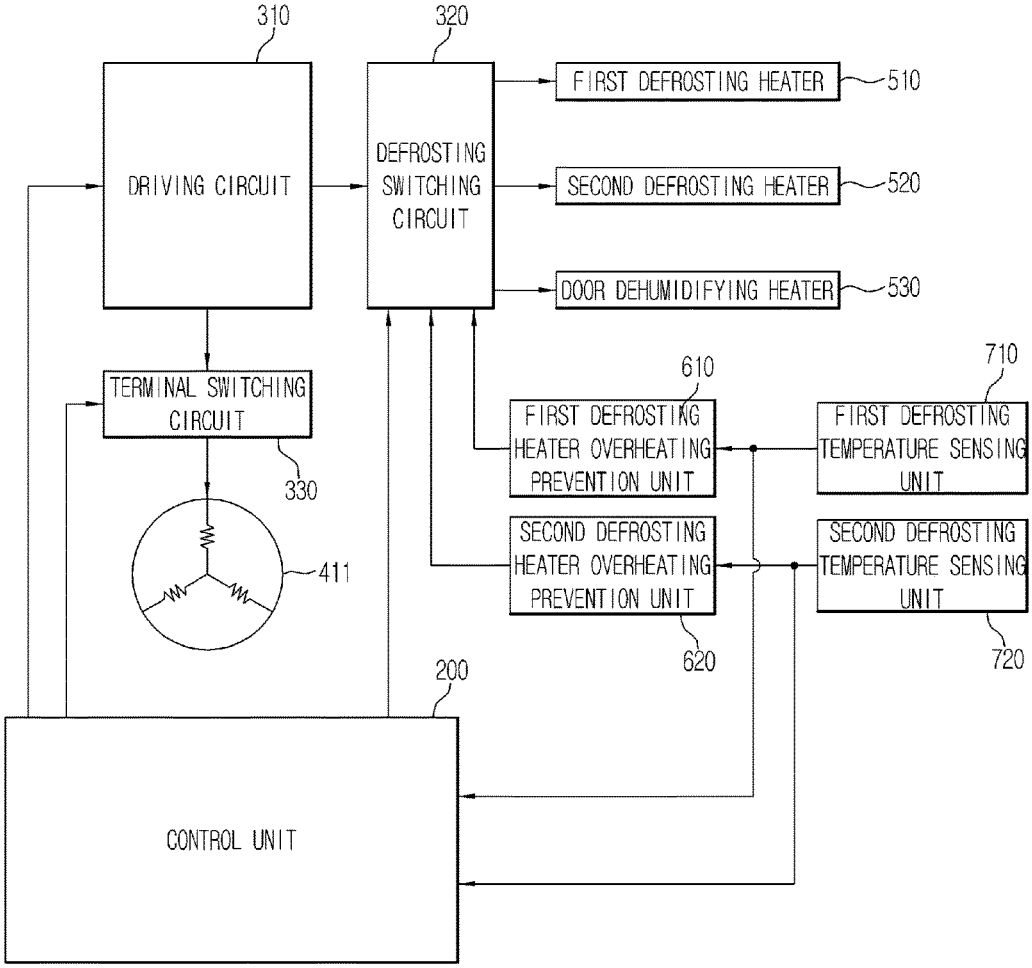
FIG. 4 is a block diagram briefly illustrating control flow of a driving apparatus of the refrigerator in accordance with the embodiment.
Figure 5:
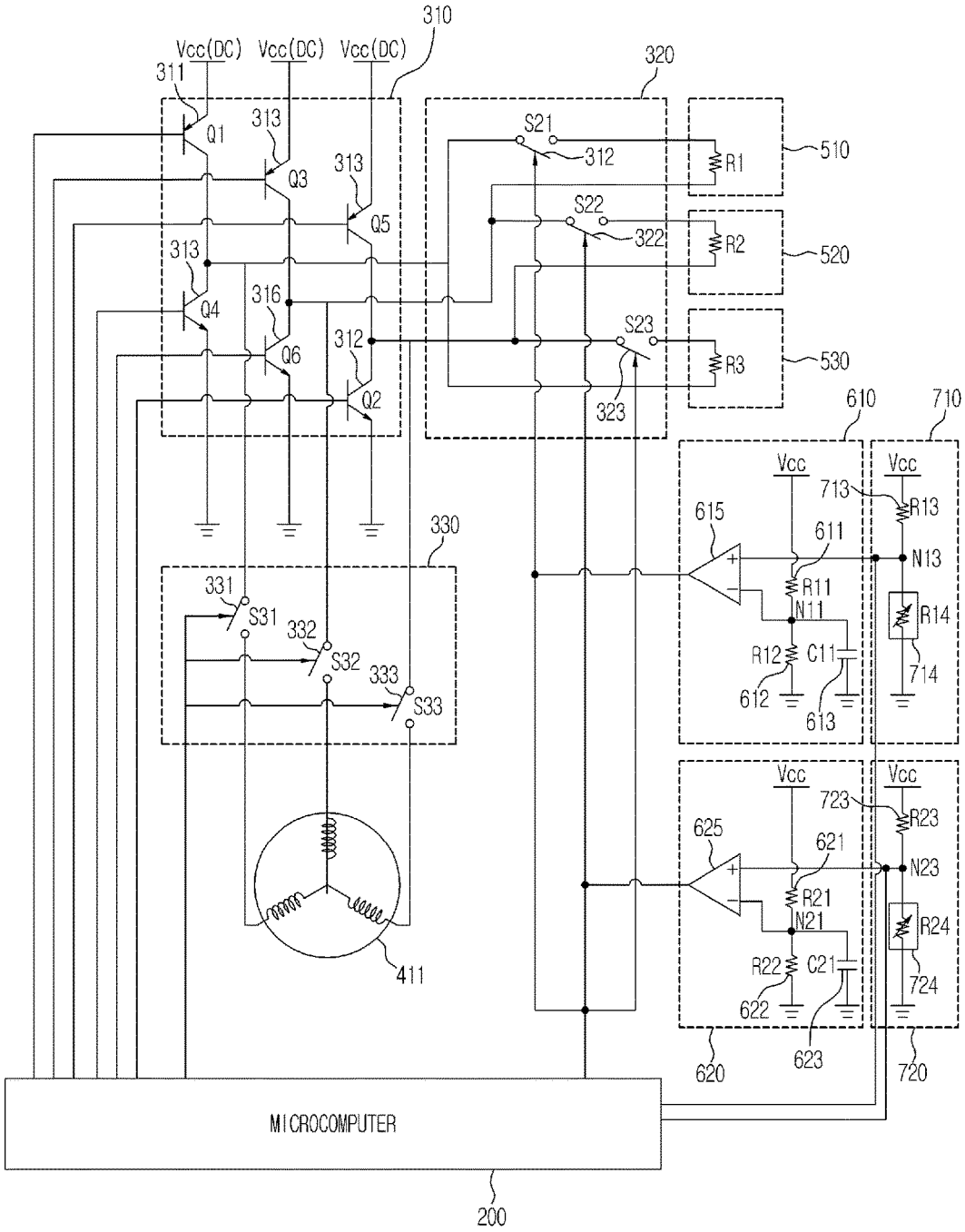
FIG. 5 is a circuit diagram illustrating the driving apparatus of the refrigerator in accordance with the embodiment.

FIG. 3 is a block diagram briefly illustrating control flow of the refrigerator 100 in accordance with the embodiment, FIG. 4 is a block diagram briefly illustrating control flow of the driving apparatus of the refrigerator 100 in accordance with the embodiment, and FIG. 5 is a circuit diagram illustrating the driving apparatus of the refrigerator 100 in accordance with the embodiment.

With reference to FIGS. 3, 4 and 5, in order to control operation of the refrigerator 100, the refrigerator 100 includes the storage temperature sensing units 161 and 162, the defrosting temperature sensing units 700, the switching valve 430, the defrosting heaters 500, a door dehumidifying heater 530, the compressor 410, the driving unit 300, the control unit 200 and the defrosting heater overheating prevention units 600. The storage temperature sensing units 161 and 162, the switching valve 430, the defrosting heaters 500, the door dehumidifying heater 530 and the compressor 410 have been described above, and a detailed description thereof will thus be omitted.

The driving unit 300 includes a driving circuit 310 providing driving current to an electric motor 411, the defrosting heaters 500 and the door dehumidifying heater 530, a terminal switching circuit 330 switching driving current provided to the electric motor 411 of the compressor 410, and a defrosting switching circuit 320 switching driving current provided to the defrosting heaters 500 and the door dehumidifying heater 530.

The driving circuit 310, as shown in FIG. 5, includes six transistors. Specifically, the driving circuit 310 includes three transistors Q1 311, Q3 313 and Q5 315 connected to power Vcc, and three transistors Q2 312, Q4 314 and Q6 316 connected to ground.

In the driving circuit 310, one of the three transistors Q1 311, Q3 313 and Q5 315 connected to power Vcc is turned on, and one of the three transistors Q2 312, Q4 314 and Q6 316 connected to ground is turned on. Therefore, driving current is provided from the power source to the electric motor 411 or the defrosting heaters 500 via one of the transistors Q1 311, Q3 313 and Q5 315, and is then provided to ground via one of the transistors Q2 312, Q4 314 and Q6 316.

The terminal switching circuit 330 is provided between the driving circuit 310 and the electric motor 411, and includes a first terminal switch S31 331, a second terminal switch S32 332 and a third terminal switch S33 333 provided at three power terminals of the electric motor 411 of the compressor 410 and three output terminals of the driving circuit 310.

One end of the first terminal switch S31 331 is connected to the first output terminal between the transistors Q1 311 and Q4 314 of the driving circuit 310, and the other end of the first terminal switch S31 331 is connected to the first power terminal of the electric motor 411. Further, one end of the second terminal switch S32 332 is connected to the second output terminal between the transistors Q3 313 and Q6 316 of the driving circuit 310, and the other end of the second terminal switch S32 332 is connected to the second power terminal of the electric motor 411. Further, one end of the third terminal switch S33 333 is connected to the third output terminal between the transistors Q5 315 and Q2 312 of the driving circuit 310, and the other end of the third terminal switch S33 333 is connected to the third power terminal of the electric motor 411.

The terminal switches 331, 332 and 333 may employ, for example, field effect transistors (FETs) or bipolar junction transistors (BJTs).

The terminal switching circuit 330 is turned on in a cooling operation mode to cool the storage chambers 120, and provides driving current from the driving circuit 310 to the electric motor 411. Further, the terminal switching circuit 330 is turned off in a defrosting operation mode to remove frost accumulated on the evaporators 450 after the cooling operation mode is stopped.

The defrosting switching circuit 320 is provided between the driving circuit 310 and the defrosting heaters 500, and provides driving current from the driving circuit 310 to the defrosting heaters 500 in the defrosting operation mode.

The defrosting switching circuit 320 includes a first defrosting switch S21 321 connected to the first defrosting heater R1 510 in series and switching driving current provided to the first defrosting heater R1 510, a second defrosting switch S22 322 connected to the second defrosting heater R2 520 in series and switching driving current provided to the second defrosting heater R2 520, and a third defrosting switch S23 323 connected to the door dehumidifying heater R3 530 in series and switching driving current provided to the door dehumidifying heater R3 530. Wherein the switching circuit 320 allows for the first defrosting heater 510, the second defrosting heater 520 and the door dehumidifying heater 530 to be activated separately or simultaneously in any combination.

Specifically, one end of the first defrosting switch S21 321 is connected to the first output terminal between the transistors Q1 311 and Q4 314 of the driving circuit 310, the other end of the first defrosting switch S21 321 is connected to one end of the first defrosting heater R1 510, and the other end of the first defrosting heater R1 510 is connected to the second output terminal between the transistors Q3 313 and Q6 316 of the driving circuit 310. Further, one end of the second defrosting switch S22 322 is connected to the second output terminal between the transistors Q3 313 and Q6 316 of the driving circuit 310, the other end of the second defrosting switch S22 322 is connected to one end of the second defrosting heater R2 520, and the other end of the second defrosting heater R2 520 is connected to the third output terminal between the transistors Q5 315 and Q2 312 of the driving circuit 310. Further, one end of the third defrosting switch S23 323 is connected to the third output terminal between the transistors Q5 315 and Q2 312 of the driving circuit 310, the other end of the third defrosting switch S23 323 is connected to one end of the door dehumidifying heater R3 530, and the other end of the door dehumidifying heater R3 530 is connected to the first output terminal between the transistors Q1 311 and Q4 314 of the driving circuit 310.

The defrosting switching circuit 320 is turned on in the defrosting operation mode and provides driving current from the driving circuit 310 to the defrosting heaters 500 or the door dehumidifying heater 530, and is turned off in the cooling operation mode and cuts driving current provided from the driving circuit 310 to the defrosting heaters 500 or the door dehumidifying heater 530 off.

The defrosting temperature sensing units 700 include the first defrosting temperature sensing unit 710 sensing the temperature of the first evaporator 451 and the second defrosting temperature sensing unit 720 sensing the temperature of the second evaporator 452, and the first defrosting temperature sensing unit 710 and the second defrosting temperature sensing unit 720 include third reference resistors R13 713 and R23 723 and thermistors R14 714 and R24 724.

Hereinafter, the structure of the first defrosting temperature sensing unit 710 will be exemplarily described. The structure of the second defrosting temperature sensing unit 720 is the same as the structure of the first defrosting temperature sensing unit 710.

As shown in FIG. 5, the first defrosting temperature sensing unit 710 takes the form of a voltage divider in which the third reference resistor R13 713 and the thermistor R14 714 are connected in series between power and ground.

Resistance of the thermistor R14 714 is varied according to temperature, and thus electric potential of a node N13 at which the third reference resistor R13 713 and the thermistor R14 714 are connected is varied. The electric potential of the node N13 is as follows.

$$V_{N13} = \frac{R_{R14}}{R_{R13} + R_{R14}} \quad \text{[Equation 1]}$$

Here, $V_{N13}$ is electric potential of the node N13, $R_{R13}$ is resistance of the third reference resistor R13, and R14 is resistance of the thermistor R14.

Specifically, a negative temperature coefficient (NTC) thermistor, the resistance of which decreases as temperature increases, may be employed as the thermistor R14 714. In this case, as the temperature of the first evaporator 451 increases, the resistance of the thermistor R14 714 decreases and the electric potential of the node N13 at which the third reference resistor R13 713 and the thermistor R14 714 are connected is lowered. On the other hand, as the temperature of the first evaporator 451 decreases, the resistance of the thermistor R14 714 increases and the electric potential of the node N13 is raised.

The defrosting temperature sensing units 700 sense the temperatures of the evaporators 450 and provide the sensed temperatures to the control unit 200 and the defrosting heater overheating prevention units 600 which will be described later. Specifically, the first defrosting temperature sensing unit 710 outputs the electric potential of the node N13 at which the third reference resistor R13 713 and the thermistor R14 714 are connected, to the control unit 200 and the defrosting heater overheating prevention units 600 which will be described later.

The control unit 200 maintains the temperatures of the storage chambers 120 at designated target storage temperatures so as to store articles for a long time. For example, the target storage temperature of the first storage chamber 121 storing articles in the refrigerated state may be set to 4° C., and the target storage temperature of the second storage chamber 122 storing articles in the frozen state may be set to −20° C. However, the target storage temperatures are not limited thereto and may be varied according to manufacture or user settings.

Further, in order to maintain the temperatures of the storage chambers 120 at the target storage temperatures, the control unit 200 operates the compressor 410 based on a sensing result of the storage temperature sensing units 161 and 162 provided in the storage chambers 120. That is, the control unit 200 operates the compressor 410 to cool the storage chambers 120 when the temperatures of the storage chambers 120 reach upper limits, which are higher than the target storage temperatures by 1° C., or higher, and stops operation of the compressor 410 when the temperatures of the storage chambers 120 reach lower limits which are lower than the target storage temperatures by 1° C., or lower.

When the compressor 410 is operated to cool the storage chambers 120, as described above, frost may be accumulated on the evaporators 450. Therefore, the control unit 200 executes the cooling operation mode to cool the storage chambers 120 when the temperatures of the storage chambers 120 reach the upper limits or higher, and terminates the cooling operation modes and executes the defrosting operation mode to remove frost accumulated on the evaporators 450 when the temperatures of the storage chambers 120 reach the lower limits or lower. Further, the control unit 200 may terminate the defrosting operation mode and then execute the cooling operation mode when the temperature of the first storage chamber 121 or the second storage chamber 122 reaches the upper limit or higher during execution of the defrosting operation mode.

However, the method of discriminating the cooling operation mode and the defrosting operation mode from each other is not limited thereto. The cooling operation mode and the defrosting operation mode may be discriminated according to the temperatures of the evaporators 450 other than the temperatures of the storage chambers 120. That is, when the temperatures of the evaporators 450 are lower than defrosting termination temperatures during the cooling operation mode, it may be estimated that frost is accumulated on the evaporators 450 and thus the control unit 200 may switch the current operation mode of the refrigerator to the defrosting operation mode, and when the temperatures of the evaporators 450 reach the defrosting termination temperatures or higher during the defrosting operation mode, it may be estimated that frost is removed from the evaporators 450 and thus the control unit 200 may switch the current operation mode of the refrigerator to the cooling operation mode. Specifically, the control unit 200 may stop operation of the compressor 410 and operate the defrosting heaters 500 when the temperatures of the evaporators 450 are lower than the defrosting termination temperatures during cooling of the storage chambers 120 by operating the compressor 410, and stop operation of the defrosting heaters 500 and operate the compressor 410 when the temperatures of the evaporators 450 reach the defrosting termination temperatures or higher during operation of the defrosting heaters 450.

Otherwise, the control unit 200 may switch the current operation mode of the refrigerator to the defrosting operation mode when a designated time from the execution of the cooling operation mode has elapsed, and switch the current operation mode of the refrigerator to the cooling operation mode when a designated time from the execution of the defrosting operation mode has elapsed.

The control unit 200 controls the driving unit 300 so that the driving circuit 310 of the driving unit 300 provides driving current to the electric motor 411 of the compressor 410 during execution of the cooling operation mode and provides driving current to the defrosting heaters 500 during execution of the defrosting operation mode.

That is to say, the defrosting heaters 500 are not operated in the cooling operation mode, and the compressor 410 is not operated in the defrosting operation mode. Specifically, the control unit 200 turns one of the terminal switching circuit 330 and the defrosting switching circuit 320 on, and thus the compressor 410 and the defrosting heaters 500 are not operated simultaneously.

Figure 6:
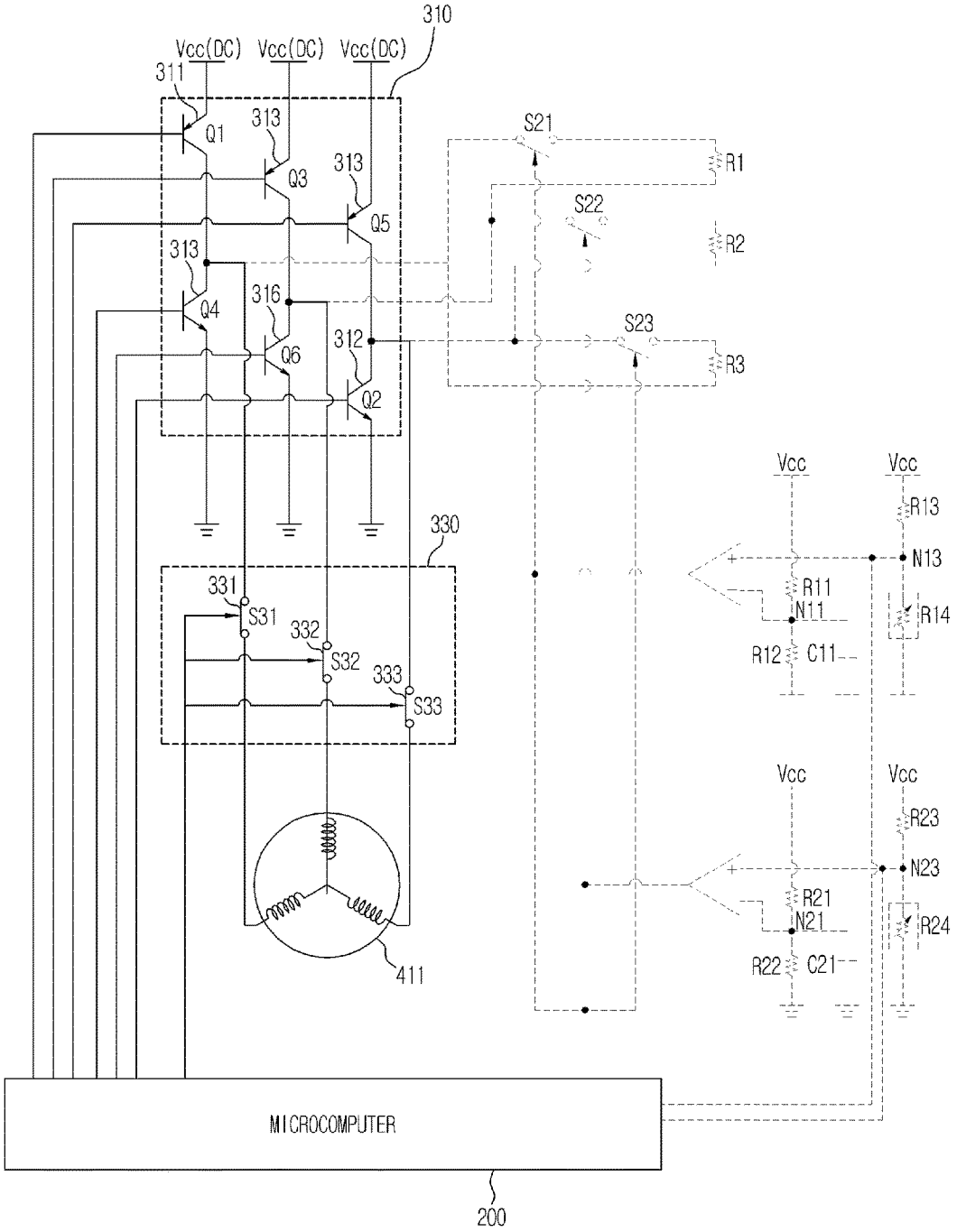
FIG. 6 is a circuit diagram illustrating the driving apparatus, if the refrigerator in accordance with the embodiment executes a cooling operation mode.

FIG. 6 is a circuit diagram illustrating the case that the refrigerator 100 in accordance with the embodiment executes the cooling operation mode. In FIG. 6, portions which are activated in the cooling operation mode are shown by a solid line, and portions which are not activated in the cooling operation mode are shown by a dotted line.

In the cooling operation mode, the control unit 200 turns the terminal switching circuit 330 on and turns the defrosting switching circuit 320 off. Further, the control unit 200 controls the driving circuit 310 so that the driving circuit 310 provides driving current to the electric motor 411 of the compressor 410.

Now, the case that a three-phase BLDC motor is used as the electric motor 411 of the compressor 410 will be exemplarily described. The control unit 200 rotates the rotor by turning the transistors Q1 311 and Q2 312 on and turning the remaining transistors Q3 313, Q4 314, Q5 315 and Q6 316 off, and then, when a designated time has elapsed, maintains rotation of the rotor by turning the transistor Q1 311 off and turning the transistor Q3 313 on. Thereafter, when a designated time has elapsed, the control unit 200 turns the transistor Q2 312 off and turns the transistor Q4 314 on.

The control unit 200 controls the driving circuit 310 in such a manner, and thus varies driving current flowing in each coil of the electric motor 411 of the compressor 410 so as to rotate the rotor of the electric motor 411.

When the temperatures of the storage chambers 120 reach the lower limits or lower, the temperatures of the evaporators 450 reach the defrosting termination temperatures or higher, or a designated time to execute the cooling operation mode has elapsed during the cooling operation mode, as described above, the control unit 200 terminates the cooling operation mode and enters the defrosting operation mode. The control unit 200 cuts driving current provided from the driving circuit 310 to the electric motor 411 off. That is, the control unit 200 turns all of transistors Q1 311, Q2 312, Q3 313, Q4 314, Q5 315 and Q6 316 of the driving circuit 310 off.

Thereafter, the control unit 200 terminates the cooling operation mode by turning the terminal switching circuit 330 off, and starts the defrosting operation mode by turning the defrosting switching circuit 320 on.

In the defrosting operation mode, the control unit 200 controls the driving circuit 310 so that the driving circuit 310 provides driving current to the defrosting heaters 500 or the door dehumidifying heater 530 according to the sensing result of the defrosting temperature sensing units 700.

As described above, after the control unit 200 cuts driving current from the driving circuit 310 to the electric motor 411 off, the control unit 200 turns the terminal switching circuit 330 off. That is, the control unit 200 turns the terminal switching circuit 330 off under the condition that driving current does not flow in the terminal switching circuit 330. Thus, a burden for the terminal switching circuit 330 to directly cut off driving current is eliminated, and damage to the terminal switching circuit 330 generated by direct cutoff of driving current by the terminal switching circuit 330 is prevented. Further, the control unit 200 turns the defrosting switching circuit 320 on so that the driving circuit 310 provides driving current to the defrosting heaters 500 or the door dehumidifying heater 530. That is, the control unit 200 turns the defrosting circuit 320 on under the condition that driving current does not flow in the defrosting circuit 320, and thus, a burden for the defrosting switching circuit 320 to directly apply current is eliminated and damage to the defrosting switching circuit 320 generated by direct flow of driving current in the defrosting switching circuit 320 is prevented.

Thereby, the defrosting switching circuit 320 and the terminal switching circuit 330 of the refrigerator 100 may employ not only IGBTs or high voltage FETs but also more inexpensive AC relays as switches to apply or cut off DC power.

Figure 7:
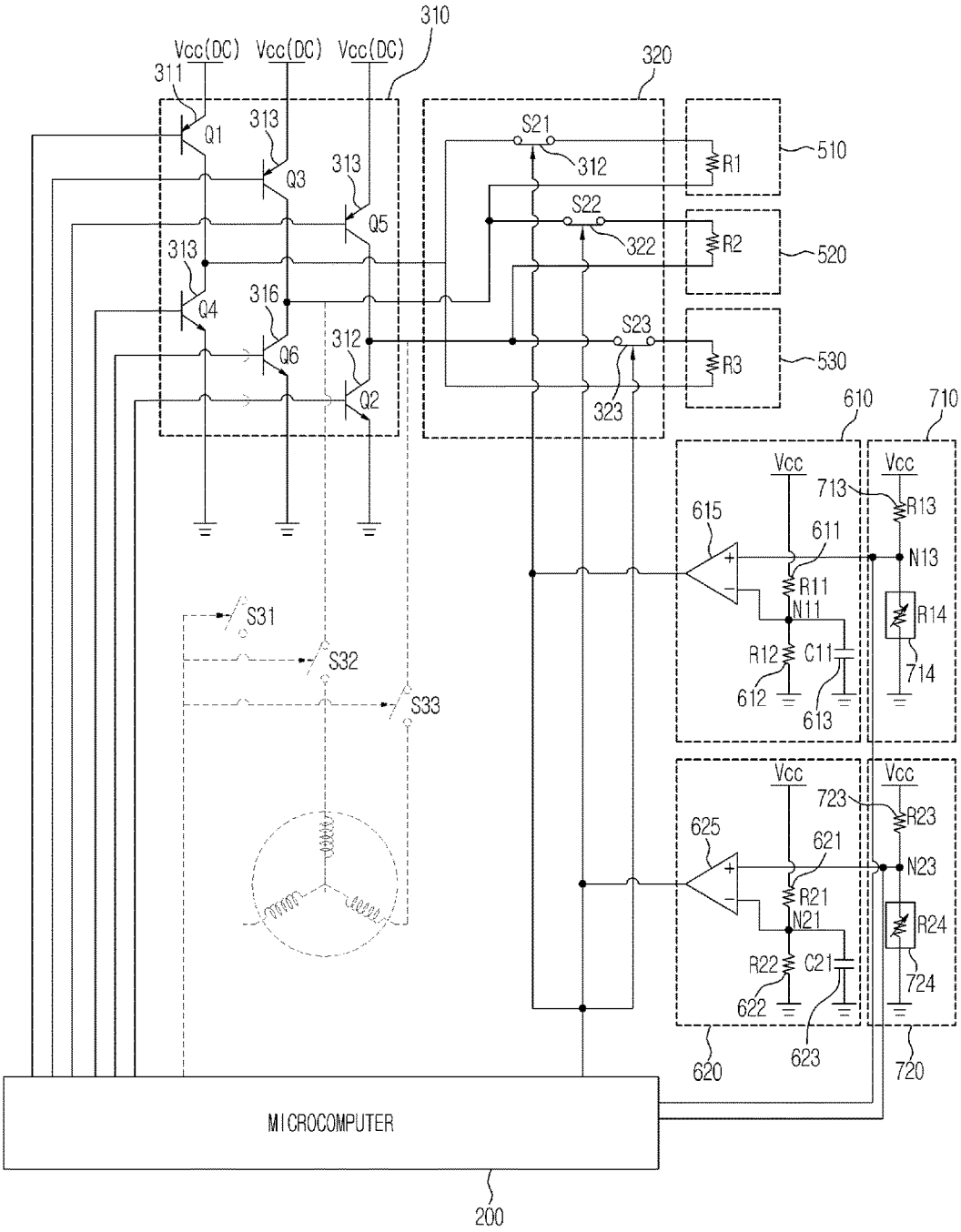
FIG. 7 is a circuit diagram illustrating the driving apparatus, if the refrigerator in accordance with the embodiment executes a defrosting operation mode.

FIG. 7 is a circuit diagram illustrating the case that the refrigerator 100 in accordance with the embodiment executes the defrosting operation mode. In FIG. 7, portions which are activated in the defrosting operation mode are shown by a solid line, and portions which are not activated in the defrosting operation mode are shown by a dotted line.

In the defrosting operation mode, the control unit 200 causes driving current to be provided to the first defrosting heater 510, the second defrosting heater 520 or the door dehumidifying heater 530 according to the sensing result of the defrosting temperature sensing units 700 by turning the defrosting switching circuit 320 on.

The control unit 200 may first remove frost accumulated on the second evaporator 451 cooling the second storage chamber 122 corresponding to a freezing chamber. That is, the control unit 200 may first operate the second defrosting heater 520, and then sequentially operate the first defrosting heater 510 and the door dehumidifying heater 530.

Specifically, when the temperature of the second evaporator 452 is lower than the defrosting termination temperature as the sensing result of the second defrosting temperature sensing unit 720 provided on the second evaporator 452, the control unit 200 turns the transistors Q3 313 and Q2 312 on and turns the remaining transistors Q1 311, Q4 314, Q3 315 and Q6 316 off. As a result, driving current flows from the power source to the transistor Q3 313, the second defrosting switch S22 322, the second defrosting heater R2 520, the transistor Q2 312 and ground, sequentially.

When driving current is provided to the second defrosting heater R2 520, the second defrosting heater R2 520 generates Joule's heat and removes frost accumulated on the second evaporator 452. Further, when the temperature of the second evaporator 451 is increased due to heat generated from the second defrosting heater R2 520 and thus reaches the defrosting termination temperature or higher, the control unit 200 turns the transistors Q3 313 and Q2 312 off so that driving current is not provided to the second defrosting heater R2 520.

After driving current provided to the second defrosting heater R2 520 is cut off, the control unit 200 judges whether or not the temperature of the first evaporator 451 is lower than the defrosting termination temperature. When the temperature of the first evaporator 451 is lower than the defrosting termination temperature, the control unit 200 turns the transistors Q1 311 and Q6 316 on and turns the remaining transistors Q2 312, Q3 313, Q4 314 and Q5 315 off. When the first defrosting heater R1 510 is operated and the temperature of the first evaporator 451 reaches the defrosting termination temperature or higher, the control unit 200 turns the transistors Q1 311 and Q6 316 off so that driving current is not provided to the first defrosting heater R1 510.

After driving current provided to the first defrosting heater R1 510 is cut off, the control unit 200 operates the door dehumidifying heater R3 530 for a designated dehumidifying time to remove frost accumulated on the doors 131 and 132 of the refrigerator 100. The control unit 200 causes driving current to be provided to the door dehumidifying heater R3 530 by turning the transistors Q5 315 and Q4 314 on and turning the remaining transistors Q1 311, Q2 312, Q3 313 and Q6 316 off.

Although the embodiment describes the first defrosting heater 510, the second defrosting heater 520 and the door dehumidifying heater 530 as being operated in order in the defrosting operation mode, embodiments of the present invention are not limited thereto.

Further, although the embodiment describes the first defrosting heater 510 as being continuously operated until the temperature of the first evaporator 451 reaches the defrosting termination temperature or higher in the defrosting operation mode, embodiments are not limited thereto, and after the first defrosting heater 510 may be operated for a designated time, the second defrosting heater 520 may be operated for a designated time and then the door dehumidifying heater 530 may be operated.

The defrosting heater overheating prevention units 600 include a first defrosting heater overheating prevention unit 610 turning the first defrosting switch S21 321 off, and a second defrosting heater overheating prevention unit 620 turning the second defrosting switch S22 322 off. Further, each of the defrosting heater overheating prevention units 600 includes a voltage divider generating reference voltage, and a comparator comparing the sensing result of each of the defrosting temperature sensing units 700 with the reference voltage.

Hereinafter, the structure of the first defrosting heater overheating prevention unit 610 will be exemplarily described. The structure of the second defrosting temperature sensing unit 620 is the same as the structure of the first defrosting temperature sensing unit 610.

As shown in FIG. 5, the first defrosting heater overheating prevention unit 610 includes a voltage divider generating reference voltage and a comparator 615 comparing the sensing result of the first defrosting temperature sensing unit 710 with the reference voltage.

The voltage divider includes a first reference resistor R11 611 and a second reference resistor R12 612 connected in series between power and ground. The first reference resistor R11 612 is connected to power and the second reference resistor R12 612 is connected to ground. Further, in order to prevent rapid variation of the output of the voltage divider, the voltage divider may further include a capacitor C11 613.

The second reference resistor R12 612 has the same resistance as the resistance of the thermistor R14 714 when the temperature of the first evaporator 451 reaches a defrosting cutoff temperature which will be described later. At this time, the first reference resistor R11 611 has the same resistance as the resistance of the third reference resistor R13 713.

The comparator 615 may compare the sensing result of the first defrosting temperature sensing unit 701 with the reference voltage, and employ an operational amplifier (OPAmp).

The comparator 615 outputs "high" when electric potential input to the positive input terminal (+) is higher than electric potential input to the negative input terminal (−) of the comparator 615, and outputs "low" when electric potential input to the positive input terminal (+) is lower than electric potential input to the negative input terminal (−) of the comparator 615. The output (electric potential of the node N13) of the first defrosting temperature sensing unit 710 is input to the positive input terminal (+) of the comparator 615, and the output (electric potential of the node N11) of the voltage divider is input to the negative input terminal (−) of the comparator 615.

AND operation between the output of the comparator 615 and the output of the control unit 200 controlling of the defrosting switching circuit 320 is carried out, thus controlling the first defrosting switch 321. That is, if both the output of the comparator 615 and the output of the control unit 200 are "high", the first defrosting switch 321 is turned on, and if at least one of the output of the comparator 615 and the output of the control unit 200 is "low", the first defrosting switch 321 is turned off.

When the temperatures of the evaporators 450 reach the defrosting termination temperatures or higher based on the sensing result of the defrosting temperature sensing units 700, the control unit 200 controls the driving circuit 310 so that driving current is not provided to the defrosting heaters 500. However, if the control unit 200 malfunctions or the transistor of the driving circuit 310 is shorted, even when the temperatures of the evaporators 450 reach than the defrosting termination temperatures or higher, driving current is continuously provided to the defrosting heaters 500 and thus the evaporators 450 and the defrosting heaters 500 may be overheated.

In order to prevent such a problem, the defrosting heater overheating prevention units 600 turn the defrosting switching circuit 320 off when the temperatures of the evaporators 450 reach the defrosting cutoff temperatures. Here, the defrosting cutoff temperatures may be set to be higher than the defrosting termination temperatures at which the driving circuit 310 does not provide driving current to the defrosting heaters 500.

Hereinafter, operation of the first defrosting heater overheating prevention unit 610 will be described. When the temperature of the first evaporator 451 is lower than the defrosting cutoff temperature, the resistance the thermistor R14 714 of the first defrosting temperature sensing unit 710 employing an NTC type thermistor, the resistance of which increases as temperature decreases, becomes higher than the resistance of the second reference resistor R12 612 of the first defrosting heater overheating prevention unit 610. Therefore, the output voltage (electric potential of the node N13) of the first defrosting temperature sensing unit 710 becomes higher than the output voltage (electric potential of the node N11) of the voltage divider, and the comparator 615 outputs "high".

When the first defrosting heater R1 510 is operated and thus the temperature of the first evaporator 451 is raised to the defrosting cutoff temperature or higher, the resistance of the thermistor R14 714 of the first defrosting temperature sensing unit 710 becomes smaller than the resistance of the second reference resistance R12 612 of the first defrosting heater overheating prevention unit 610. Here, the output voltage (electric potential of the node N13) of the first defrosting temperature sensing unit 710 becomes lower than the output voltage (electric potential of the node N11) of the first defrosting heater overheating prevention unit 610, and thus, the comparator 615 outputs "low".

Since the first defrosting heater overheating prevention unit 610 outputs "low", the first defrosting switch S21 321 is turned off and driving current provided to the first defrosting heater R1 510 is cut off.

As described above, the defrosting heater overheating prevention units 600 cut off driving current provided to the defrosting switching circuit 320 based on the sensing result of the defrosting temperature sensing units 700.

Figure 8:
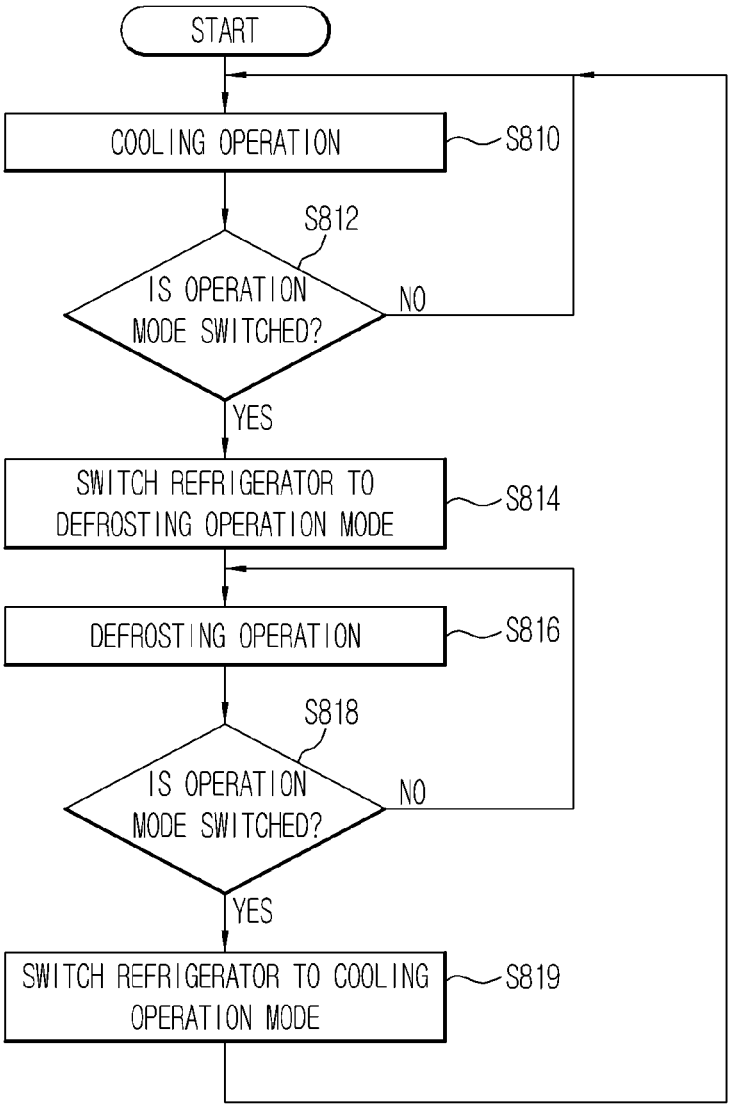
FIG. 8 is a flowchart illustrating operation of the refrigerator in accordance with the embodiment.

FIG. 8 is a flowchart illustrating operation of the refrigerator 100 in accordance with the embodiment.

The refrigerator 100 judges whether or not the refrigerator 100 is switched to the defrosting operation mode during execution of the cooling operation mode (Operation S810) in which the storage chambers 120 are cooled (Operation S812). That is, when the temperatures of the storage chambers 120 reach the lower limits or lower, the temperatures of the evaporators 450 are lower than the defrosting termination temperatures, or a designated cooling operation time has elapsed, the refrigerator 100 is switched to the defrosting operation mode (Operation S814).

After switching of the refrigerator 100 from the cooling operation mode to the defrosting operation mode, the refrigerator 100 executes the defrosting operation mode in which the defrosting heaters 500 are operated to remove frost accumulated on the evaporators 450 (Operation S816).

Thereafter, whether or not the refrigerator 100 is switched to the cooling operation mode from the defrosting operation mode is judged (S818). When the temperatures of the storage chambers 120 reach the upper limits or higher, the temperatures of the evaporators 450 reach the defrosting termination temperatures or higher, or a designated defrosting operation time has elapsed, the refrigerator 100 is switched to the cooling operation mode (Operation S819).

After switching of the refrigerator 100 from the defrosting operation mode to the cooling operation mode, the refrigerator 100 operates the compressor 410 to cool the storage chambers 120.

Figure 9:
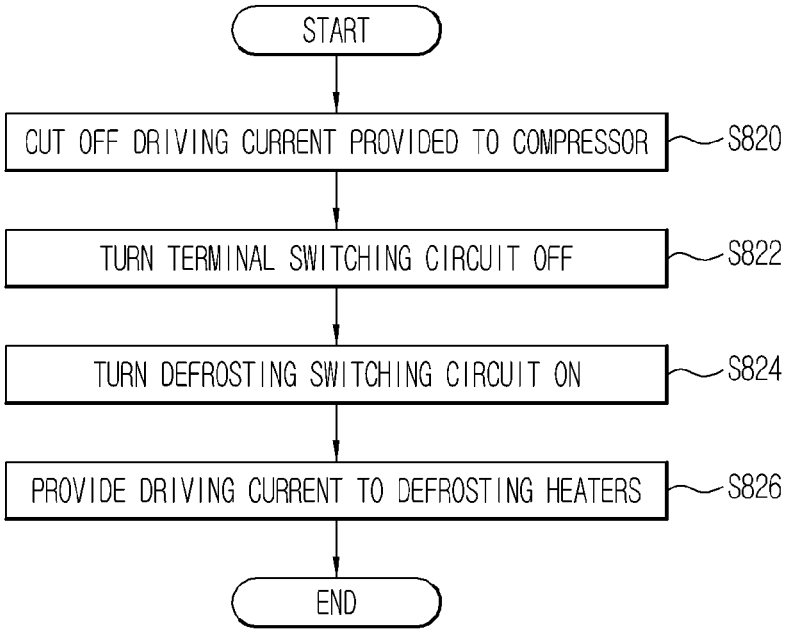
FIG. 9 is a flowchart illustrating a process of switching the refrigerator in accordance with the embodiment from the cooling operation mode to the defrosting operation mode.

FIG. 9 is a flowchart illustrating a process of switching the refrigerator 100 in accordance with the embodiment from the cooling operation mode to the defrosting operation mode.

When the refrigerator 100 is switched from the cooling operation mode to the defrosting operation mode, the refrigerator 100 first cuts driving current provided to the compressor 410 off (Operation S820).

When driving current provided to the compressor 410 is cut off, the refrigerator 100 turns the terminal switching circuit 330 off (Operation S822) and turns the defrosting switching circuit 320 on (Operation S824).

When the defrosting switching circuit 320 is turned on, the refrigerator 100 provides driving current to the defrosting heaters 500 (Operation S826).

Figure 10:
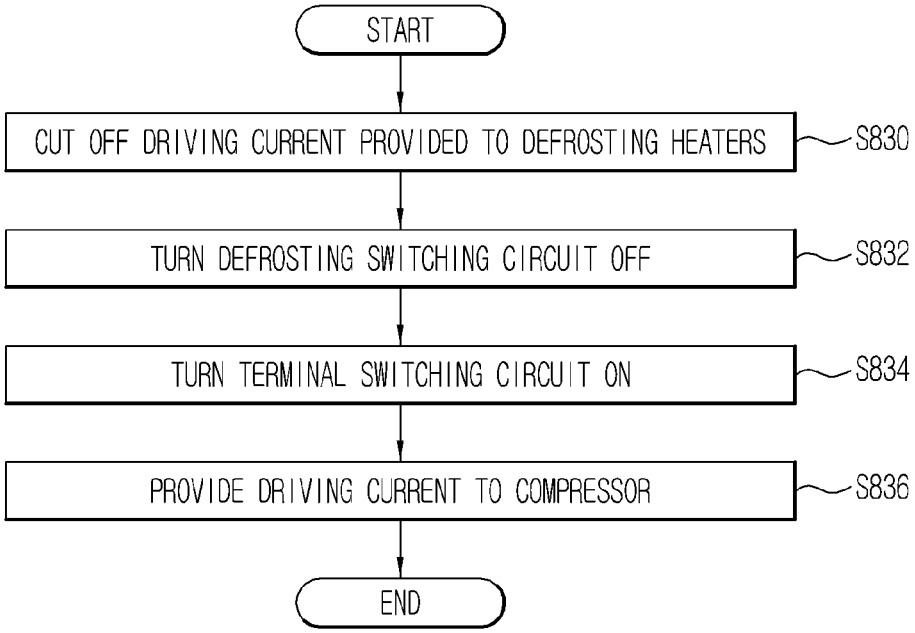
FIG. 10 is a flowchart illustrating a process of switching the refrigerator in accordance with the embodiment from the defrosting operation mode to the cooling operation mode.

FIG. 10 is a flowchart illustrating a process of switching the refrigerator 100 in accordance with the embodiment from the defrosting operation mode to the cooling operation mode.

When the refrigerator 100 is switched from the defrosting operation mode to the cooling operation mode, the refrigerator 100 first cuts driving current provided to the defrosting heaters 500 off (Operation S830).

When driving current provided to the defrosting heaters 500 is cut off, the refrigerator 100 turns the defrosting switching circuit 320 off and turns the terminal switching circuit 330 on (Operation S834).

When the terminal switching circuit 330 is turned on, the refrigerator 100 provides driving current to the compressor 410 (Operation S836).

As is apparent from the above description, a refrigerator using DC power in accordance with one embodiment controls defrosting heaters using a driving circuit controlling a compressor, thus lowering the manufacturing costs of the refrigerator.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A cooling apparatus comprising:

an evaporator configured to evaporate a refrigerant;

a compressor configured to compress the evaporated refrigerant to a high pressure;

a defrosting heater configured to remove frost accumulated on the evaporator;

a driving unit configured to provide driving current selectively to the compressor or the defrosting heater; and a control unit configured to control the driving unit to provide the driving current to the compressor in a cooling operation mode and to control the driving unit to provide the driving current to the defrosting heater in a defrosting operation mode, wherein the driving unit includes:

a single driving circuit configured to provide the driving current to the compressor or the defrosting heater;

a terminal switching circuit provided between the compressor and the single driving circuit, and configured to switch the driving current provided to the compressor; and a defrosting switching circuit provided between the defrosting heater and the single driving circuit, and configured to switch the driving current provided to the defrosting heater, and wherein, when the cooling apparatus is switched from the cooling operation mode to the defrosting operation mode, the control unit sequentially performs:

controlling the single driving circuit to cut off driving current provided to the compressor;

turning off the terminal switching circuit;

turning on the defrosting switching circuit; and controlling the single driving circuit to provide driving current to the defrosting heaters.

2. The cooling apparatus according to claim 1, wherein the single driving circuit includes at least two output terminals, the terminal switching circuit includes at least two terminal switches, designated sides of the at least two terminal switches are respectively connected to the at least two output terminals of the single driving circuit, and the other sides of the at least two terminal switches are respectively connected to power terminals of the compressor.

3. The cooling apparatus according to claim 1, wherein the single driving circuit includes at least two output terminals, the defrosting switching circuit includes at least one defrosting switch connected to the defrosting heater, the at least one defrosting switch is connected to one of the at least two output terminals of the single driving circuit, and the defrosting heater is connected to the other of the at least two output terminals of the defrosting switching circuit.

4. The cooling apparatus according to claim 1, wherein the single driving circuit includes at least two transistors connected to power and at least two transistors connected to ground.

5. The cooling apparatus according to claim 4, wherein the single driving circuit provides the driving current to the compressor or the defrosting heater by turning one of the at least two transistors connected to power on and turning one of the at least two transistors connected to ground on.

6. The cooling apparatus according to claim 1, wherein, when the driving current is provided to the compressor, the control unit turns the terminal switching circuit on and controls the single driving circuit so as to provide the driving current to the compressor.

7. The cooling apparatus according to claim 1, wherein, when the driving current is provided to the defrosting heater, the control unit turns the defrosting switching circuit on and controls the single driving circuit so as to provide the driving current to the defrosting heater.

8. The cooling apparatus according to claim 1, further comprising defrosting temperature sensing units sensing the temperature of the evaporator.

9. The cooling apparatus according to claim 8, wherein the control unit controls the single driving circuit so as to provide the driving current to the defrosting heater according to a sensing result of the defrosting temperature sensing units.

10. The cooling apparatus according to claim 9, wherein the control unit controls the single driving circuit so as to provide the driving current from the single driving circuit to the defrosting heater when the temperature of the evaporator is lower than defrosting termination temperatures, and controls the single driving circuit so as to cut off the driving current provided from the single driving circuit to the defrosting heater when the temperature of the evaporator is not lower than the defrosting termination temperatures.

11. The cooling apparatus according to claim 8, further comprising an overheating prevention unit cutting the driving current provided to the defrosting heater off by turning the defrosting switching circuit off when the temperature of the evaporator is not lower than defrosting cutoff temperatures.

12. A driving apparatus driving a cooling apparatus which has an evaporator evaporating a refrigerant, a compressor compressing the evaporated refrigerant to a high pressure, and a defrosting heater removing frost accumulated on the evaporator, the driving apparatus comprising:

a single driving circuit configured to provide driving current to the compressor or the defrosting heater;

a terminal switching circuit configured to switch the driving current provided from the single driving circuit to the compressor; and a defrosting switching circuit configured to switch the driving current provided from the single driving circuit to the defrosting heater, a control unit controlling the single driving circuit, the terminal switching circuit and the defrosting switching circuit to provide driving current to the compressor in a cooling operation mode, and controlling the single driving circuit, the terminal switching circuit and the defrosting switching circuit to provide driving current to the defrosting heater in a defrosting operation mode, wherein, when the cooling apparatus is switched from the cooling operation mode to the defrosting operation mode, the control unit sequentially performs:

controlling the single driving circuit to out off driving current provided to the compressor;

turning off the terminal switching circuit;

turning on the defrosting switching circuit; and controlling the single driving circuit to provide driving current to the defrosting heaters.

13. The driving apparatus according to claim 12, wherein the single driving circuit includes at least two output terminals, the terminal switching circuit includes at least two terminal switches provided between the single driving circuit and the compressor, designated sides of the at least two terminal switches are respectively connected to the at least two output terminals of the single driving circuit, and the other sides of the at least two terminal switches are respectively connected to power terminals of the compressor.

14. The driving apparatus according to claim 12, wherein the single driving circuit includes at least two output terminals, the defrosting switching circuit includes at least one defrosting switch connected to the defrosting heater, the at least one defrosting switch is connected to one of the at least two output terminals of the single driving circuit, and the defrosting heater are connected to the other of the at least two output terminals of the defrosting switching circuit.

15. The driving apparatus according to claim 12, wherein the single driving circuit includes at least two transistors connected to power and at least two transistors connected to ground.

16. The driving apparatus according to claim 15, wherein the single driving circuit provides the driving current to the compressor or the defrosting heater by turning one of the at least two transistors connected to power and one of the at least two transistors connected to ground on.

* * * * *